United States Patent [19]

Wueger

[11] 3,945,406

[45] Mar. 23, 1976

[54] LENO SELVEDGE DEVICE AND METHOD OF FORMING A LENO SELVEDGE

[75] Inventor: Karl W. Wueger, North Brookfield, Mass.

[73] Assignee: Crompton & Knowles Corporation, Worcester, Mass.

[22] Filed: Aug. 26, 1974

[21] Appl. No.: 500,792

[52] U.S. Cl. ..... 139/54

[51] Int. Cl.[2] ..... D03C 11/00; D03C 7/00

[58] Field of Search ..... 139/48, 49, 50, 54, 122 S

[56] References Cited

UNITED STATES PATENTS

| | | | |
|---|---|---|---|
| 2,703,587 | 3/1955 | Allenson | 139/54 |
| 3,613,741 | 10/1971 | Ravella | 139/54 |

*Primary Examiner*—James Kee Chi

[57] ABSTRACT

A leno selvage device and method of forming a leno selvage for a loom wherein a pair of leno threads extend from supply packages through a pair of thread guides to the selvage. The thread guides are rotated around a horizontal axis which lies substantially between and intermediate the guides so that the guides will alternately occupy upper and lower shed positions and are caused to dwell in the upper and lower shed positions. The device includes a stationary cam surface which circumscribes said axis and a lever for each guide which is attached to the guide at one end and to a cam follower at its other end for engagement with the cam surface.

7 Claims, 4 Drawing Figures

FIG. 1
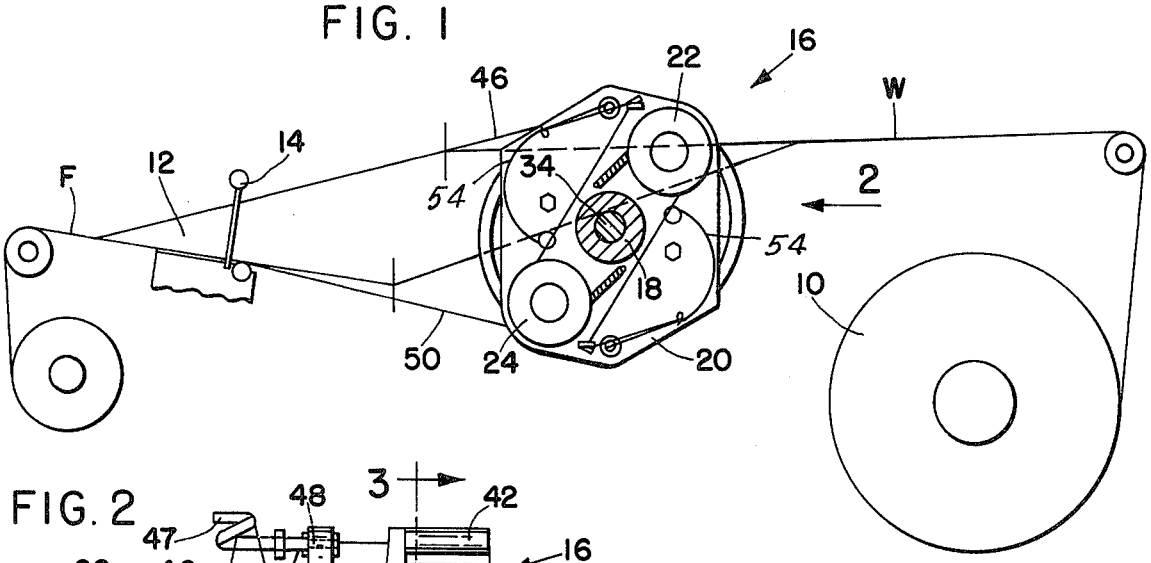
FIG. 2
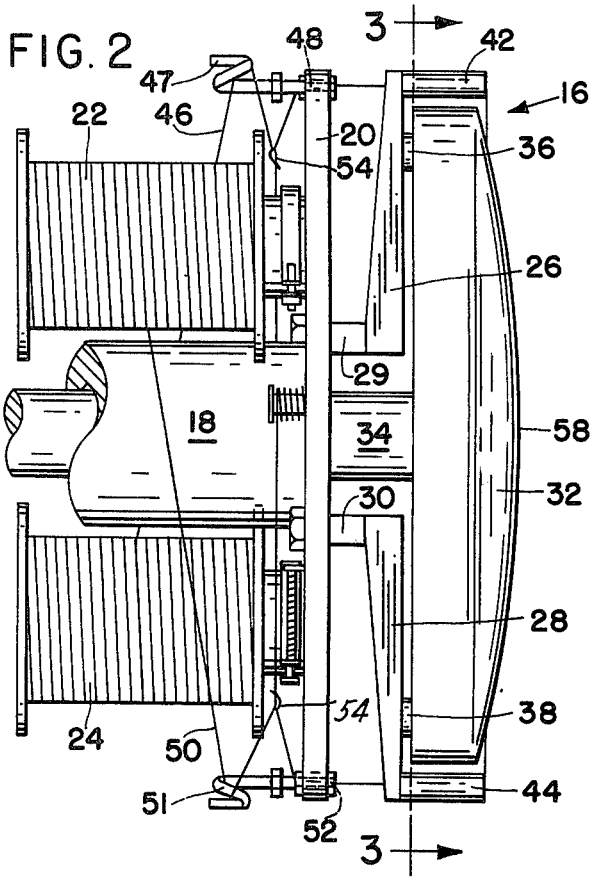
FIG. 4
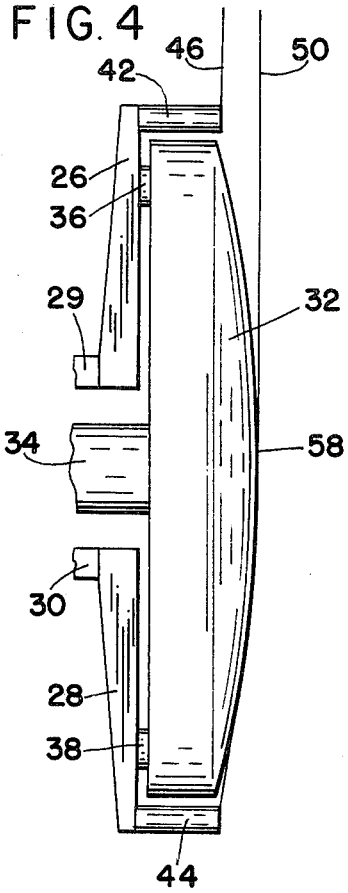
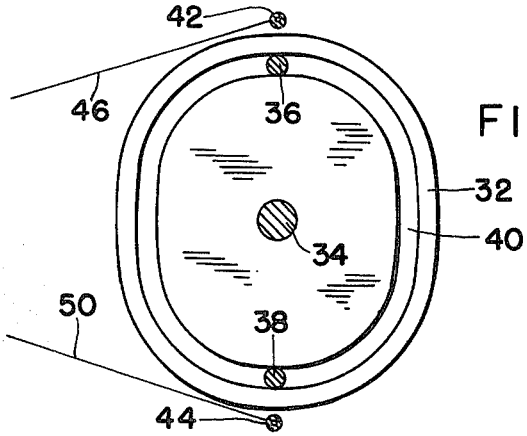
FIG. 3

LENO SELVEDGE DEVICE AND METHOD OF FORMING A LENO SELVEDGE

BACKGROUND OF THE INVENTION

This invention relates to mechanism for forming a leno selvage in a loom and the method for forming such a selvage.

One of the more successfull leno devices currently being used includes a rotating disc having a pair of spaced guide holes. A pair of leno threads extend through the guide holes from a pair of supply packages mounted on the disc to the selvage. For each rotation of the disc, the two leno threads occupy upper and lower shed positions alternately. Since the guide eyes are mounted on the disc, the movement of the leno threads between upper and lower shed positions is harmonic. Although vertical movement of the leno threads reaches the zero point at the extreme upper and lower positions, it is not a true dwell. Weft insertion in the loom occurs from a period of time before the leno threads reach their extreme vertical or "open" shed positions and a period of time after. The threads will cross after the weft has been inserted and as they move towards opposite vertical positions, a new weft is inserted. The timing of the various loom functions such as weft insertion has to be done within the bounds of the natural harmonic motion of the leno threads. In the past, this natural harmonic motion has been more than adequate. The leno shed is opened to a greater extent than necessary so that the leno threads will be spaced a sufficient amount for a longer period of time. With the advent of higher speed looms, less time is available for opening the leno shed so that there is a greater need to keep the leno shed opening to a minimum. It is also desired that the leno threads cross quickly so that the filling ends will be locked in place before beat-up. There are other leno devices which control the leno shed opening with cams so that the leno threads will dwell in the open position and then cross relatively quickly. This solution is not as good for the loom speeds which are contemplated. The cam has to be larger, there are more moving parts, the moving parts have greater mass and due to the mass of the moving parts, there are limitations in designing a cam contour. Accelerations have to be gradual when there is a change in direction of cam followers and associated parts.

SUMMARY OF THE INVENTION

It is a principal object of the invention to provide a mechanism and a method which combines the advantages of low inertia of the "rotating disc" type of leno device and timing versatility of a cam.

The object of the invention is accomplished by guides which are rotated around a horizontal axis. Each guide is mounted on one end of a pivoted lever and a cam follower is mounted on the other end of the lever. The cam follower engages a stationary cam surface which circumscribes said horizontal axis and is designed for causing the leno threads to dwell in the "open" position and to cross relatively quickly thereafter. The levers are relatively small and the amount of pivoting motion very short. The motion of the levers is a combination of pivoting and rotation around the track of the cam. This, together with the small mass of the levers, provides for greater versatility in the design of the cam track. The follower may move from a high point of the cam to a low point in very few degrees of rotation of the cam and consequently provide longer periods of dwell in the high and low positions.

BRIEF DESCRIPTION OF THE DRAWINGS

FIG. 1 is a fragmentary elevational view of a portion of a loom with a device embodying the main features of the present invention shown in connection therewith;

FIG. 2 is an elevation of the leno device of the present invention, looking in the direction of arrow 2 in FIG. 1 and shown on an enlarged scale;

FIG. 3 is a vertical section taken along line 3—3 in FIG. 2 and looking in the direction of the arrows and shown on a reduced scale; and FIG. 4 is a fragmentary plan view of the leno device shown in FIG. 2 showing the leno threads in the vertical crossing position.

DETAILED DESCRIPTION OF THE INVENTION

Referring more particularly to FIG. 1 of the drawings, there is shown a portion of a loom including a warp beam 10 from which is fed warp yarns W which are formed into a shed 12 by shedding mechanism, not shown. Weft yarn is inserted into shed 12 and is then beaten in by a reed 14 to form a fabric F.

Located at each edge of the loom is a leno mechanism embodying the present invention and indicated generally at 16, only one of which is shown in FIG. 1. The mechanism at the other side of the loom is identical to the one shown in FIG. 1 but of opposite hand.

Leno mechanism 16 includes a hollow shaft 18 rotatably driven in timed relation with the loom and a support disc 20 fixed to the shaft. There are two thread supply packages, 22 and 24, mounted on one side of support disc 20 and two levers, 26 and 28, pivotally mounted at 29 and 30, respectively, on the opposite side of the disc 20. A stationary cam 32 is mounted adjacent levers 26 and 28 on a fixed shaft 34 which extends freely through hollow shaft 18. Cam followers 36 and 38 are mounted on levers 26 and 28, respectively for following engagement in a track 40 in cam 32, see FIG. 3. Tubular thread guides 42 and 44 are also mounted on levers 26 and 28, respectively, at points spaced from followers 36 and 38, respectively, and extend beyond the outer circumference of cam 32.

A leno thread 46 extends from package 22 through a guide 47 and an opening 48 in disc 20 and finally through guide 42 to the beat-up point at the fell of the fabric. A second leno thread 50 extends through a guide 51 and an opening 52 in disc 20 and finally through guide 44 to the fell. Spring tension members 54 engage threads 46 and 50 between guides 47 and 51, respectively, and openings 48 and 52, respectively, to take-up slack and maintain the threads under tension.

Shaft 18 is timed so that disc 20 makes one revolution for two beats of the loom or once for two shed crossings of the warp yarns W. During each revolution of the disc 20, followers 36 and 38 will make one complete trip along track 40. If we assume that a revolution begins from the position shown in the drawings, follower 36 will move from the upper position as shown in FIG. 3 to the lower position in half of a revolution of the disc 20 and follower 38 will move from the lower position as shown in FIG. 3 to the upper position. This will cause leno thread 46 to move from the upper position as shown in FIG. 1 to the lower position and leno thread 50 will move from the lower position to the upper position. During the next half of the revolution of disc 20, followers 36 and 38 will return to the positions shown in FIG. 3 and leno threads 46 and 50 will cross from the lower and upper positions, respectively, to the upper and lower positions, respectively.

The rotation of disc 20 also causes the leno threads to twist or to cross horizontally once for each vertical crossing. To make sure that the leno threads 46 and 50 are kept separated at the time they cross each other vertically, cam 32 is provided with an external cam surface 58 which urges the rearmost leno thread toward the center of the loom which is toward the right as shown in FIG. 4. As shown in that Figure, thread 50 is in the rearmost position and is shown deflected to the right by surface 58 to urge it away from thread 46 to avoid interference therewith. After one half of a revolution of the disc 20, the positions of guides 42 and 44 will be reversed so that thread 46 will be in the rearmost position and deflected to the right as viewed in FIG. 4. Cam surface 58 guarantees that leno threads 46 and 50 will not interfere with each other during vertical crossing thereof.

Cam track 40 is designed so that followers 36 and 38 dwell substantially in the upper and lower positions as shown in FIG. 3 and then move vertically relatively quickly thereafter. The vertical crossing of the leno threads coincides with the vertical crossing of the warp yarns. This crossing occurs before beat-up to insure that the weft yarn which has just been inserted is held sufficiently.

I claim:

1. A device for forming a leno weave at the selvage of a loom comprising:

a. a rotatably driven shaft;

b. a support fixed to said shaft c. at least two selvage thread supply packages fixed to said support;

d. a stationary cam having a cam surface which circumscribes the longitudinal axis of said shaft;

e. a lever for each of said supply packages which are pivotally mounted on said support, each of said levers having a follower for engagement with said cam surface and a thread guide spaced from said follower for guiding a selvage thread from its respective supply package so that the threads leading from said supply packages to the selvage of a loom will be crossed vertically to alternately occupy upper and lower positions and crossed laterally once for each vertical crossing thereof.

2. The selvage warp feeding means as set forth in claim 1 wherein said cam surface is effective to enable said selvage threads to dwell in said upper and lower positions.

3. The device as set forth in claim 1 comprising means for laterally separating said threads during the vertical crossing thereof.

4. The device as set forth in claim 3 wherein said thread separating means comprises a second cam surface on said cam which deflects each of said threads alternately once for each rotation of said driven shaft.

5. The selvage thread feeding means as described in claim 1 wherein said driven shaft is tubular and said cam is mounted on a stationary shaft, a portion of which is supportably mounted within said driven shaft so that said driven shaft rotates relative to said stationary shaft.

6. A method of forming a two thread leno selvage in a loom comprising the following steps:

a. extending a pair of leno threads from a pair of supply packages through a pair of spaced guides to the selvage in a loom;

b. rotating said thread guides around a horizontal axis which lies substantially parallel to the fell line of the cloth and which lies substantially between and intermediate said guides so that they will alternately occupy upper and lower shed positions;

c. causing said guides to dwell substantially in said upper and lower shed positions;

d. rotating said supply packages around said axis once for each rotation of said guides and in the same direction thereof; and e. guiding said threads from said thread guides in a spaced relationship in a direction substantially parallel to the warp to a point between the guide nearest the fell of the cloth and the fell of the cloth, whereby said threads will not interfere with each other during crossing.

7. A device for forming a leno weave at the selvage of a loom comprising:

a. a pair of spaced guides for a pair of leno threads from a pair of supply packages;

b. means for rotating said guides around a horizontal axis which lies substantially parallel to the fell line of the cloth and which lies intermediate said guides so that they will alternately occupy upper and lower shed positions;

c. means for causing said thread guides to dwell in their upper and lower shed positions;

d. means for rotating said supply packages around said axis and in the same direction as said guides; and e. means for guiding said threads from said thread guides in a spaced relationship in a direction substantially parallel to the warp to a point between the guide nearest the fell of the cloth and the fell of the cloth, whereby said threads will not interfere with each other during crossing.

* * * * *